US006516689B1

(12) United States Patent
Bates

(10) Patent No.: US 6,516,689 B1
(45) Date of Patent: Feb. 11, 2003

(54) RATCHET WRENCH

(75) Inventor: Darryle E. Bates, Cuyahoga Falls, OH (US)

(73) Assignee: Stride Tool, Inc., Ellicottville, NY (US)

( * ) Notice: Subject to any disclaimer, the term of this patent is extended or adjusted under 35 U.S.C. 154(b) by 0 days.

(21) Appl. No.: 09/708,839

(22) Filed: Nov. 8, 2000

(51) Int. Cl.[7] ..... B25B 13/46
(52) U.S. Cl. ..... 81/60; 81/58
(58) Field of Search ..... 81/58, 58.1, 60, 81/61, 62, 63, 63.1, 63.2

(56) References Cited

U.S. PATENT DOCUMENTS

| | | | | | |
|---|---|---|---|---|---|
| 1,018,080 | A | | 2/1912 | Reston | |
| 1,371,350 | A | | 3/1921 | Campbell | |
| 1,578,065 | A | | 3/1926 | Bemus et al. | |
| 1,626,906 | A | | 5/1927 | Zilliox | |
| 1,769,070 | A | | 7/1930 | Nowosielski | |
| 2,636,411 | A | * | 4/1953 | Wood | 81/60 |
| 2,757,564 | A | * | 8/1956 | Reaves | 81/61 |
| 2,897,437 | A | | 7/1959 | Briggs et al. | |
| 2,982,160 | A | | 5/1961 | Little | |
| 3,039,340 | A | | 6/1962 | Livermont | |
| 3,505,714 | A | | 4/1970 | Boileau | |
| 3,572,188 | A | | 3/1971 | Christian, Jr. | |
| 4,278,314 | A | | 7/1981 | Taub | |
| 4,324,158 | A | | 4/1982 | Le Roy | |
| 4,441,387 | A | * | 4/1984 | Hendricks | 81/61 |
| 4,480,511 | A | | 11/1984 | Nickipuck | |
| 4,703,676 | A | * | 11/1987 | Mayer | 81/60 |
| 4,748,874 | A | | 6/1988 | Sharp et al. | |
| 4,768,405 | A | | 9/1988 | Nickipuck | |
| 4,791,837 | A | | 12/1988 | Main | |
| 4,825,732 | A | | 5/1989 | Arnold | |
| 4,905,549 | A | | 3/1990 | Nickipuck | |
| 4,938,107 | A | | 7/1990 | Nickipuck | |
| 5,005,448 | A | * | 4/1991 | Main | 81/63 |
| 5,289,745 | A | | 3/1994 | Beardsley | |
| 5,291,809 | A | | 3/1994 | Fox, III et al. | |
| 5,901,620 | A | * | 5/1999 | Arnold | 81/60 |
| 6,009,777 | A | | 1/2000 | Jarvis | |
| 6,263,766 | B1 | * | 7/2001 | Jarvis | 81/60 |

FOREIGN PATENT DOCUMENTS

| | | |
|---|---|---|
| DE | 0 027 238 | 4/1981 |

* cited by examiner

*Primary Examiner*—James G. Smith
(74) *Attorney, Agent, or Firm*—Watts, Hoffmann, Fisher & Heinke Co., L.P.A.

(57) ABSTRACT

A ratchet wrench is disclosed. The wrench includes a handle including a head and an elongate grippable portion. The head includes toothed walls defining a palm socket receiving aperture. The handle carries a manually actuatable spring biased lever having a latching portion projecting into the aperture in a normal position and an external actuating portion spaced from the latching portion for manual actuation against the spring bias to shift the latching portion from its normal position to a release position at least partially within a lever recess in the handle. A palm ratchet is disclosed which has a toothed perimeteral portion insertable into the aperture when the latching portion is in its release position. The perimeteral portion includes a surface defining a latching recess for receiving the latching portion when the latching portion is in the normal position thereby maintaining the handle and palm ratchet in a connected condition. The toothed wall and the toothed portion being coactably engageable whereby forces applied to the handle will rotatively drive the palm ratchet.

10 Claims, 2 Drawing Sheets

RATCHET WRENCH

TECHNICAL FIELD

This invention relates to ratchet wrenches and more particularly to that class of wrenches known as palm ratchets.

BACKGROUND

Ratchet wrenches are well known. With a typical ratchet wrench a socket of a selected size is attached to the wrench and placed in engagement with a threaded fastener. A handle is provided which is used to drive the socket for either tightening or loosening the fastener. The wrench includes a ratcheting mechanism which selectively is positionable in a position to tighten a threaded fastener or a reverse position to loosen the fastener. In either event, the handle is freely rotatable relative to the socket in an opposed direction. That is, with a right hand threaded fastener and the ratchet positioned in the on-position, the handle will drive the socket in a clockwise rotation but can be moved freely in a counterclockwise direction relative to the socket and vise versa for loosening a fastener.

So called palm ratchets have gained considerable popularity. With a palm ratchet one is able readily to manually grasp the palm ratchet for, as an example, relative rotation of a nut and a bolt. When the nut and bolt reach a relatively snug position and it is desired torque the two to firmly clamp the fastener against a work piece, a removable handle is connected to the palm ratchet to provide leverage for torquing the fastener into its desired tightened position.

U.S. Pat. No. 6,009,777 issued Jan. 4, 2000 to Jack D. Jarvis, discloses one such palm ratchet and removable handle. With the tool of the Jarvis patent, the handle is threadedly connected to a so-called palm ratchet. The Jarvis device has several disadvantages. First, because its connection includes a threaded connection, connection or disconnection of the handle to the ratchet is slow. Secondly, the Jarvis ratchet includes a projection to receive the handle which projection interferes with operation of the ratchet when it is functioning as a palm ratchet. Further, the handle cannot be connected to the palm ratchet when a socket carried by the ratchet is engaging a fastener. Rather the palm fastener must be removed from the fastener for the handle to be connected.

Accordingly, it would be desirable to provide a palm ratchet adapted for simpler and quicker connection and disconnection of a handle.

SUMMARY OF INVENTION

According to the present invention, a palm ratchet is provided which includes a generally cylindrical toothed or serrated surface. A coacting ratchet handle has a bore defined by serrated or toothed walls that selectively drivingly engage the toothed or serrated surface of the ratchet. The toothed surface of the ratchet provides a dual function in that in addition to mating with the handle teeth, the surface facilitates gripping by an operator when the handle is not attached.

In the preferred and disclosed arrangement, the toothed ratchet surface is adjacent the top of the ratchet and is of larger diameter than portions of the ratchet projecting oppositely from a socket connection projection. With this construction, the ratchet may be telescoped into the handle bore even when the palm ratchet has an attached socket in engagement with a fastener in a relatively inaccessible position. Further, a stop is provided to provide axial location of the handle and the palm ratchet.

The toothed surface of the ratchet is interrupted by an annular groove or recess which is centrally located axially. The handle carries a spring biased lever which has a retracted position enabling the ratchet to be telescoped into or removed from the handle bore. The lever has a spring biasing it toward a handle retention position in which the lever projects into the ratchet groove to maintain a ratchet to handle connection. When the ratchet and handle are so connected their respective teeth are meshed such that the handle may be operated to apply torque to the ratchet.

One of the outstanding features of the tool of this invention is that the ratchet may be telescoped into the handle bore from either side so as to position the lever selectively and one at a time in locations respectively convenient to the thumbs of right and left handed users of the tool.

Accordingly, the objects of the inventions are to provide a novel and improved palm ratchet and handle arrangement and novel and improved handle for actuating of a palm ratchet.

DETAILED DESCRIPTION OF THE PREFERRED EMBODIMENT

Figure 1:
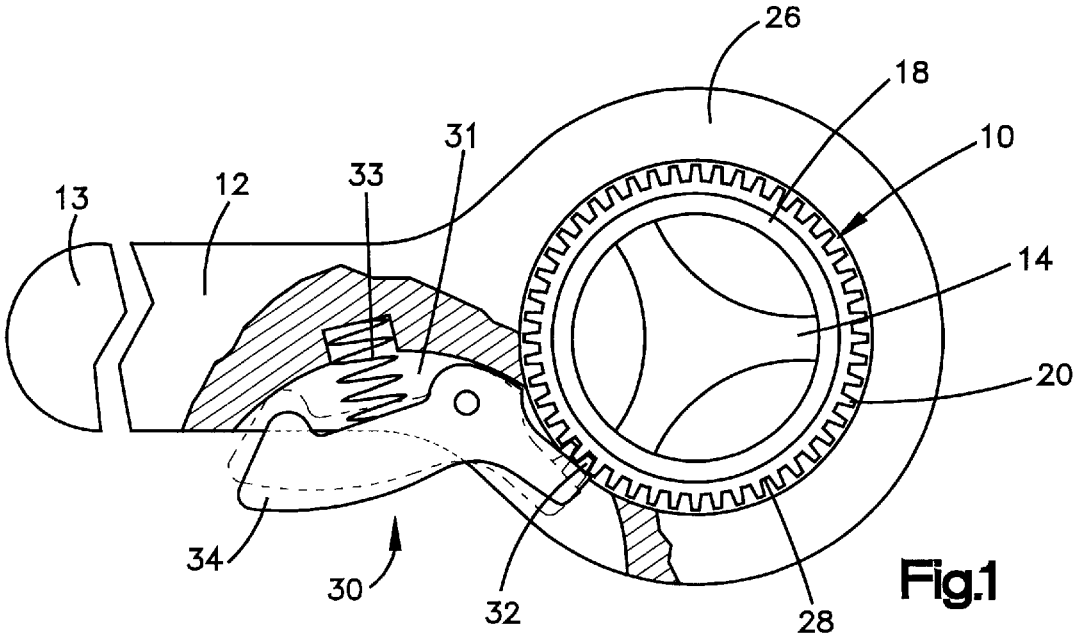
FIG. 1 is a plan view, with parts broken away and removed for clarity of illustration, of the wrench and handle of this invention.

Referring to the drawings, a palm ratchet is shown generally at 10. A handle 12 is removably connectable to the palm ratchet. The handle 12 includes an elongated manually grippable portion 13 and is shown in foreshortened form in FIGS. 1 and 2.

A selector knob 14 is provided. The selector knob is rotatable between fastener on and fastener off positions in a manner that is now well known and conventional in ratchet wrenches. That is, the rachet is selectively positioned for driving a socket in either a clockwise or a counter clockwise direction. The palm ratchet 10 includes internal ratcheting mechanism which may be any of the many known ratcheting mechanisms that are well known to one skilled in the art.

The ratchet includes the usual socket engaging, preferably square, drive 16 which is adapted to receive and hold sockets of a range of sizes in a conventional and well known manner.

The palm ratchet includes a body 18 which is manually grippable for quick relative rotation of two fastener elements in either an on or an off direction. The body 18 includes a perimeteral toothed surface 20. An annular groove 22 is centrally disposed, axially speaking, of the toothed surface 20 such that the toothed surface has upper and lower segments 24, 25. The handle 12 includes an apertured head 26 defining a toothed inner surface 28. The teeth of the ratchet and handle surfaces 20,28 are complementally formed for meshing engagement as is shown in FIG. 1. Thus, the handle 12 receives the palm ratchet in the aperture of the head 26 in telescopic relationship with the teeth interengaged to provided a drivingly engaged relationship.

Expressed another way, the teeth are intractable surface parts which transmit operator supplied bases from the handle to the body of the socket.

A moveable engagement retainer selectively secures the handle and ratchet together. In its preferred form the retainer is a spring biased finger actuable lever 30 provides one of the outstanding features of the invention. The lever 30 which is pivotally mounted in a lever recess 31 in the handle 12. Normally, a spring 33 biases the lever into a palm ratchet retaining position shown in FIGS. 1 and 2. In the retaining position, a tip or latching portion 32 of the lever 30 projects into the groove 22 to maintain the palm ratchet within the aperture of the handle head 26. Thus, the groove functions as a latching recess. Upon depression of an external latching portion 34 of the lever 30 to move it from its solid to its dotted line position of FIG. 1, the palm ratchet 10 is movable axially of the handle head aperture for insertion into or removal from the aperture.

Figure 2:
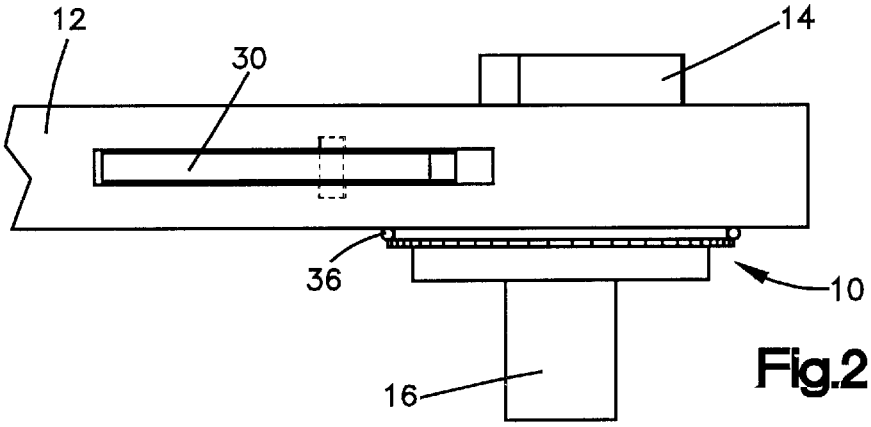
FIG. 2 is a side elevational view of the wrench and handle of FIG. 1.
Figure 3:
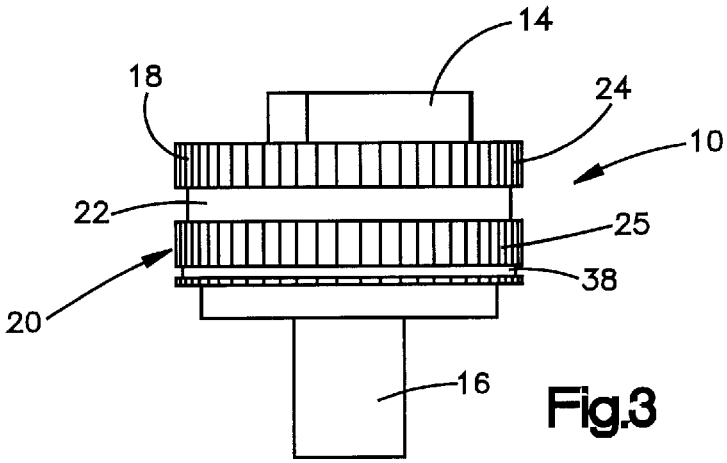
FIG. 3 is an elevational view of the palm ratchet of the present invention with the handle removed.

A snap ring 36 is disposed in part within a groove 38. The groove 38 is near the base of the toothed surface 20. As seen in FIG. 2, the snap ring engages a lever surface of the handle head 26. Thus, the snap ring functions to provide relative axial location of the handle and ratchet.

The engagement retainer may take other forms. For example, a moveable pin carried by one of the handle and ratchet and engageable with a recess in the other will provide the desired retention of a handle to ratchet connection. Such a pin or other similar arrangement is preferrably spring biased.

Figure 4:
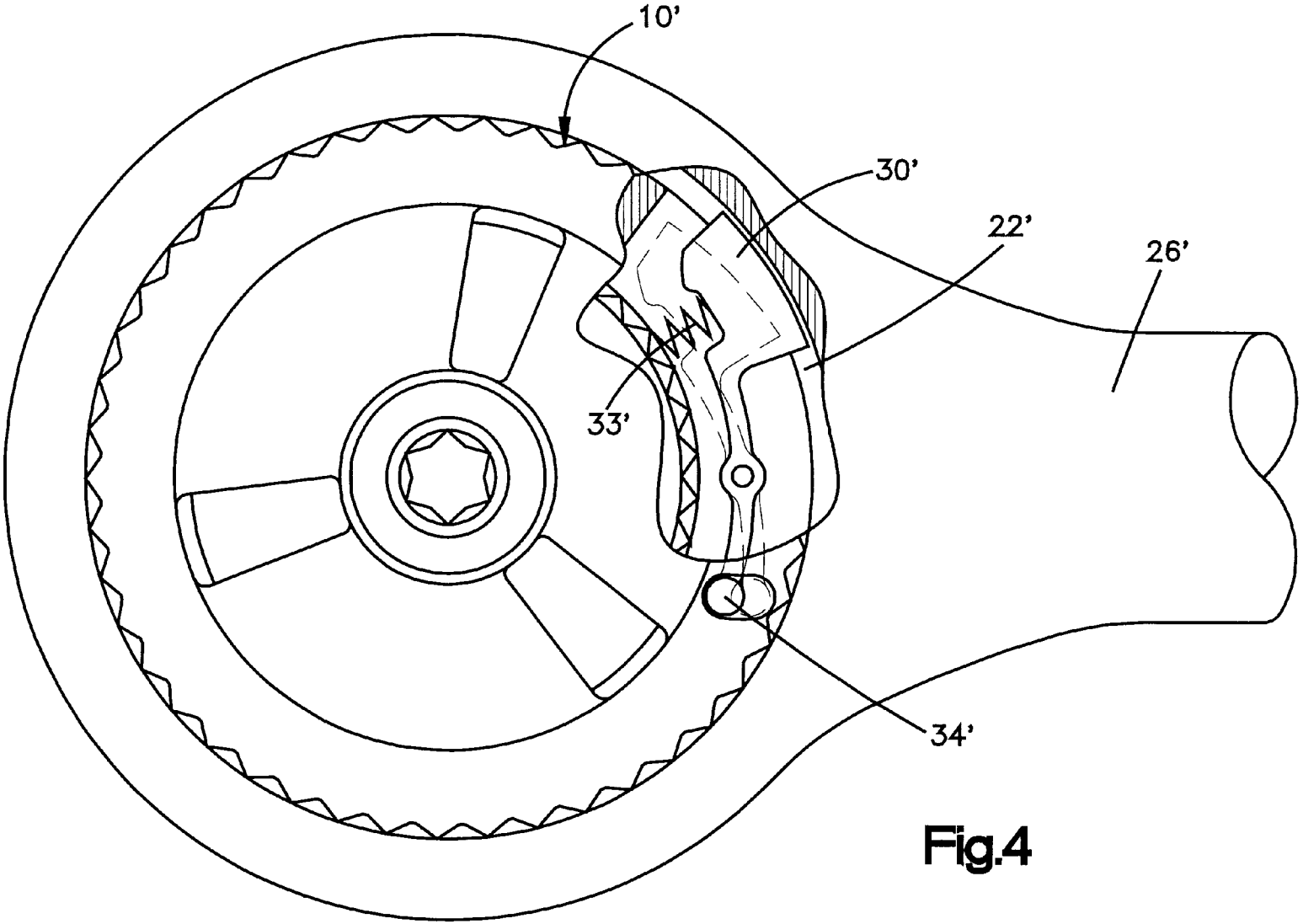
FIG. 4 is a plan of the wrench with an alternate lever arrangement.

FIG. 4 illustrates an alternate embodiment in which there is a reversal of parts. That is a lever 30' is carried by the palm ratchet 10'. As shown in solid lines the lever 30' extends into a groove 22' formed in the handle 26'. A spring 33' biases the lever 30' into the position shown in solid lines in FIG. 4 for maintaining the handle 26' connected to the palm ratchet 10'. By applying force to the actuating portion 34' of the lever 30' one may shift the lever from its solid line position of FIG. 4 to its dotted line position against the action of the spring 33'. Once the lever 30' is in the dotted line or phantom position, the lever may be removed from or mounted on the palm ratchet 10'.

Operation

In use, a socket of a selected size, not shown, is mounted on the socket projection 16. The palm ratchet is then grasped manually, the socket is engaged with a fastener to be rotated, and the socket is rotated manually until the engaged fastener is snug. Thereupon the palm ratchet may be left in its fastener engaged relationship. Next the handle lever 30 is shifted to the dotted line position of FIG. 1, the palm ratchet is telescoped into the aperture of the head 26 until the head 26 engages the snap ring 36. The lever is then released to put it in its connection retaining position of FIGS. 1 and 2. Thereupon the handle is used to rotate the body 18 of the ratchet and with it the connected socket.

For fastener removal, the procedure is reversed. That is, a palm ratchet off position is selected in the conventional way. The handle is actuated to loosen the fastener until it is sufficiently loose to make manual rotation of the palm ratchet without the handle desirable. Thereupon the lever is depressed, the handle disconnected from the palm ratchet and the disconnection of the fastener is completed by manually rotating the palm ratchet 10.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

What is claimed is:

1. A ratchet wrench for use in connecting and disconnecting threaded fasteners comprising:

a) a body having a handle engaging perimeteral surface;

b) a socket drive connected to and projecting from the body for receipt of a fastener engaging socket;

c) a ratchet mechanism housed within the body and operably interposed between the body and the drive;

d) the ratchet mechanism being adjustable between on and off conditions selectively and one at a time such that in one condition rotation of the body in a clockwise direction drives the drive in a clockwise direction while the body and drive are relatively rotatable in a counterclockwise direction and in the other condition rotation of the body in a counterclockwise direction drives the drive in a counterclockwise direction while the body and drive are relatively rotatable in a clockwise direction;

e) a handle including a surface defining a body receiving aperture;

f) the surfaces including interactable surface parts for transmitting operator supplied body driving forces from the handle to the body; and g) a selected one of the body and the handle including an engagement lever having a normal position interactable with a complemental recess in the other for releasably retaining a portion of the body within the handle aperture, the lever also being moveable from its normal position to a release position to permit removal of the body from the handle aperture.

2. The wrench of claim 1 wherein the surface parts are teeth.

3. The wrench of claim 1 wherein the complemental recess is an annular groove.

4. The wrench of claim 1 wherein the lever is spring based.

5. The wrench of claim 1 wherein the lever is carried by the handle.

6. A ratchet wrench comprising:

a) a handle including a head and an elongate gripable portion;

b) the head including toothed walls defining a palm socket receiving aperture;

c) a manually actuatable spring biased lever having a latching portion projecting into the aperture in a normal position;

d) the lever having an external actuating portion spaced from the latching portion for manual actuation against the spring bias to shift the latching portion from its normal position to a release position at least partially within a lever recess in the handle, the lever recess communicating with the aperture;

e) a palm ratchet having a toothed perimeteral portion insertable into the aperture when the latching portion is in its release position;

f) the perimeteral portion including surfaces defining a latching recess for receiving the latching portion when the latching portion is in the normal position thereby maintaining the handle and palm ratchet in a connected condition; and, g) the toothed walls and the toothed portion being coactably engageable whereby forces applied to the handle will rotatively drive the palm ratchet.

7. The wrench of claim 6 wherein the palm ratchet includes an internal ratcheting mechanism selectively positionable one at a time in fastener tightening and fastener loosening positions.

8. The wrench of claim 6 wherein the latching recess is an annular groove.

9. The wrench of claim 6 wherein the handle head has spaced opposed surfaces delineating ends of the aperture and the palm ratchet perimeteral portion is insertable into the aperture selectively and one at a time through each of the opposed surfaces to provide left and right handed connections.

10. A handle for removable connection to a palm ratchet comprising:

a) an elongate body having an operator grippable portion near one end and a head near an opposite end;

b) the head including surfaces defining a through bore having an axis transverse to an elongate axis of the body;

c) the surfaces including inwardly projecting teeth portions adapted to drivingly engage complemental surface portions on a palm ratchet in coacting driving relationship;

d) the body also including an engagement retainer receiving space in communication with the bore;

e) a retainer in the form of a spring biased lever pivotally mounted in the space, the lever having a ratchet retention end portion near one end and a spaced operator accessible portion near an opposite end;

f) the retainer having a ratchet insertion and removal position wherein the retention end portion is substantially disposed within the space and a ratchet retention position wherein the retention end portion is at least partially disposed within the bore for coaction with a ratchet to maintain such ratchet connected to the handle; and g) the accessible portion being adapted for operator access whereby an operator may shift the retainer from the retention position to the insertion and removal position against the action of the spring.

* * * * *